US012358714B2

(12) United States Patent
Essenius

(10) Patent No.: US 12,358,714 B2
(45) Date of Patent: Jul. 15, 2025

(54) COVER ELEMENT FOR FORMING A SO-CALLED INTERNAL FLOATING ROOF IN A LIQUID TANK

(71) Applicant: Emission Zero B.V., Schiedam (NL)

(72) Inventor: Robin Alexander Essenius, Schiedam (NL)

(73) Assignee: Emission Zero B.V., Schiedam (NL)

( * ) Notice: Subject to any disclaimer, the term of this patent is extended or adjusted under 35 U.S.C. 154(b) by 15 days.

(21) Appl. No.: 18/285,289

(22) PCT Filed: Mar. 22, 2022

(86) PCT No.: PCT/NL2022/050151
§ 371 (c)(1),
(2) Date: Oct. 2, 2023

(87) PCT Pub. No.: WO2022/211617
PCT Pub. Date: Oct. 6, 2022

(65) Prior Publication Data

US 2024/0190643 A1 Jun. 13, 2024

(30) Foreign Application Priority Data

Apr. 1, 2021 (NL) ..... 1043983

(51) Int. Cl.
*B65D 88/36* (2006.01)

(52) U.S. Cl.
CPC ..... *B65D 88/36* (2013.01)

(58) Field of Classification Search
CPC ..... B65D 90/22; B65D 81/245; B65D 88/36; B65D 88/34; B65D 88/38; B65D 88/40;
(Continued)

(56) References Cited

U.S. PATENT DOCUMENTS 3,043,468 A * 7/1962 Horner, Jr. ..... B65D 88/50 220/226
4,130,217 A * 12/1978 Hills ..... F16J 15/3204 277/439

(Continued)

FOREIGN PATENT DOCUMENTS

| | | | |
|---|---|---|---|
| NL | 7812624 | A | 12/1978 |
| WO | 2008048496 | A2 | 4/2008 |
| WO | 2008048496 | A3 | 4/2008 |

OTHER PUBLICATIONS

International Search Report and Written Opinion of the International Searching Authority issued in corresponding application PCT/NL2022/050151 mailed May 23, 2022 (10 pages).

*Primary Examiner* — Kareen K Thomas
(74) *Attorney, Agent, or Firm* — Carter, DeLuca & Farrell LLP; Vadim Vapnyar

(57) ABSTRACT

Cover element for forming a floating covering for a liquid tank, comprising a housing (1*a,* 1*b*) having a first longitudinal coupling profile (2) and a second longitudinal coupling profile (3), as a result of which two adjacent housings (1 *a,* 1 *b*) may be coupled to one another by means of hook hinge profiles (2*a,* 3*a*) at the bottom and top coupling profiles (2*b,* 3*b*) and a locking profile (7). The end faces of the housings (1*a,* 1*c*) are provided with a transverse coupling profile (10) which is configured to cooperate with a sliding coupling profile (9) which is slid over the transverse coupling profiles of both adjacent housings. In this configuration, the cover elements are coupled to one another by a coupling construction that does not protrude beyond the main planes (4*a,* 4*b*) of the cover elements, as a result of which the surface of the entire floating roof is smooth, resulting in a substantial reduction in the accumulation of dirt etc. on the roof due to the absence of the vertical coupling flanges.

2 Claims, 2 Drawing Sheets

(58) Field of Classification Search
CPC ..... B65D 88/42; B65D 88/44; B65D 88/46; B65D 88/48; B65D 88/50
See application file for complete search history.

(56) References Cited

U.S. PATENT DOCUMENTS

| | | | | | |
|---|---|---|---|---|---|
| 4,308,968 | A | * | 1/1982 | Thiltgen | B65D 88/50 220/221 |
| 4,552,090 | A | * | 11/1985 | Coleman | B65D 90/48 220/222 |
| 4,710,292 | A | * | 12/1987 | DeVos | B01D 19/02 210/DIG. 9 |
| 4,880,135 | A | * | 11/1989 | Neou | B65D 90/38 220/721 |
| 5,078,799 | A | * | 1/1992 | Matter | B01F 25/212 134/40 |
| 5,172,825 | A | * | 12/1992 | Clay | B65D 88/54 220/565 |
| 5,941,027 | A | | 8/1999 | Hallsten | |
| 9,926,044 | B1 | | 3/2018 | Su | |

* cited by examiner

COVER ELEMENT FOR FORMING A SO-CALLED INTERNAL FLOATING ROOF IN A LIQUID TANK

CROSS-REFERENCE TO RELATED APPLICATIONS

This application is a National Stage Application under 35 U.S.C. § 371 (a) of PCT/NL2022/050151, filed on Mar. 22, 2022, which claims the benefit of and priority to Netherlands Patent Application No. 1043983 filed on Apr. 1, 2021. The entire contents of the foregoing applications are incorporated by reference herein.

BACKGROUND

The invention relates to a device, intended as a cover element for forming, coupled together with similar cover elements, a floating covering for the contents of a liquid tank.

It is generally known for the liquid contents of liquid tanks to be covered from above with a so-called floating (tank) roof; see for example https://www.infomil.nl/onderwerpen/lucht-water/lucht/activiteiten/overslag-0/overslag/.

To date, the floating cover elements have been coupled to one another by means of vertical flanges that protrude above the upper main plane of the cover elements.

SUMMARY

The present invention aims to provide a configuration in which the floating cover elements are coupled to one another by a construction that does not protrude (substantially) above the upper (and lower) main plane of the floating cover elements, thus achieving a situation in which the entire floating roof is smooth from above (and from below), resulting in a substantial reduction in the accumulation of dirt etc. on the roof due to the absence of the vertical coupling flanges, and also a significant improvement in the discharge of condensation water and cleaning liquid etc. when the tank is being cleaned.

To this end, the invention provides a device, intended and configured as a cover element for forming, coupled with similar cover elements, a floating covering for the contents of a liquid tank, which device comprises an elongate housing having a first longitudinal coupling profile made of extruded material on one side extending in a length direction, and a second longitudinal coupling profile made of extruded material on the other side, wherein both longitudinal coupling profiles are configured such that two adjacent housings may be coupled to one another by means of the first longitudinal coupling profile of the one housing and the second longitudinal coupling profile of the adjacent housing, wherein the first longitudinal coupling profile and the second longitudinal coupling profile do not protrude substantially above or below the upper main plane or the lower main plane, respectively, of the housing, and wherein the lower portions of the first longitudinal coupling profile and the second longitudinal coupling profile have a first hook hinge profile and a second hook hinge profile, respectively, which are configured, and shaped, in such a way that the housings may be hooked together at the bottom in a hinged manner by means of the first hook hinge profile and the second hook hinge profile, after which the top sides of said housings may be moved towards each other, whereas the upper portions of the first longitudinal coupling profile and the second longitudinal coupling profile have a first second top coupling profile and a second top coupling profile, respectively, which are configured to be able to be coupled to one another by means of a locking profile that can be fitted over the first top coupling profile and the second top coupling profile. The first top coupling profile or the second top coupling profile is preferably provided with a screw sleeve in which self-tapping locking screws may be inserted by screwing in order to fix or secure the locking profile fitted on the first top coupling profile and the second top coupling profile.

The end faces of the housing are preferably provided with a transverse coupling profile which is configured to cooperate, for the purpose of coupling similar housings at the end faces, with a sliding coupling profile which is configured to be able to be slid over or through the transverse coupling profiles of both adjacent housings.

BRIEF DESCRIPTION OF THE DRAWINGS

The invention will now be discussed in more detail on the basis of the description of the figures below.

FIG. 1 shows a cross section of two adjacent housings 1 which are coupled, by way of their sides, to one another by means of a pivoting movement and locked, see FIGS. 1*a-e*.

DETAILED DESCRIPTION

Figure 1:
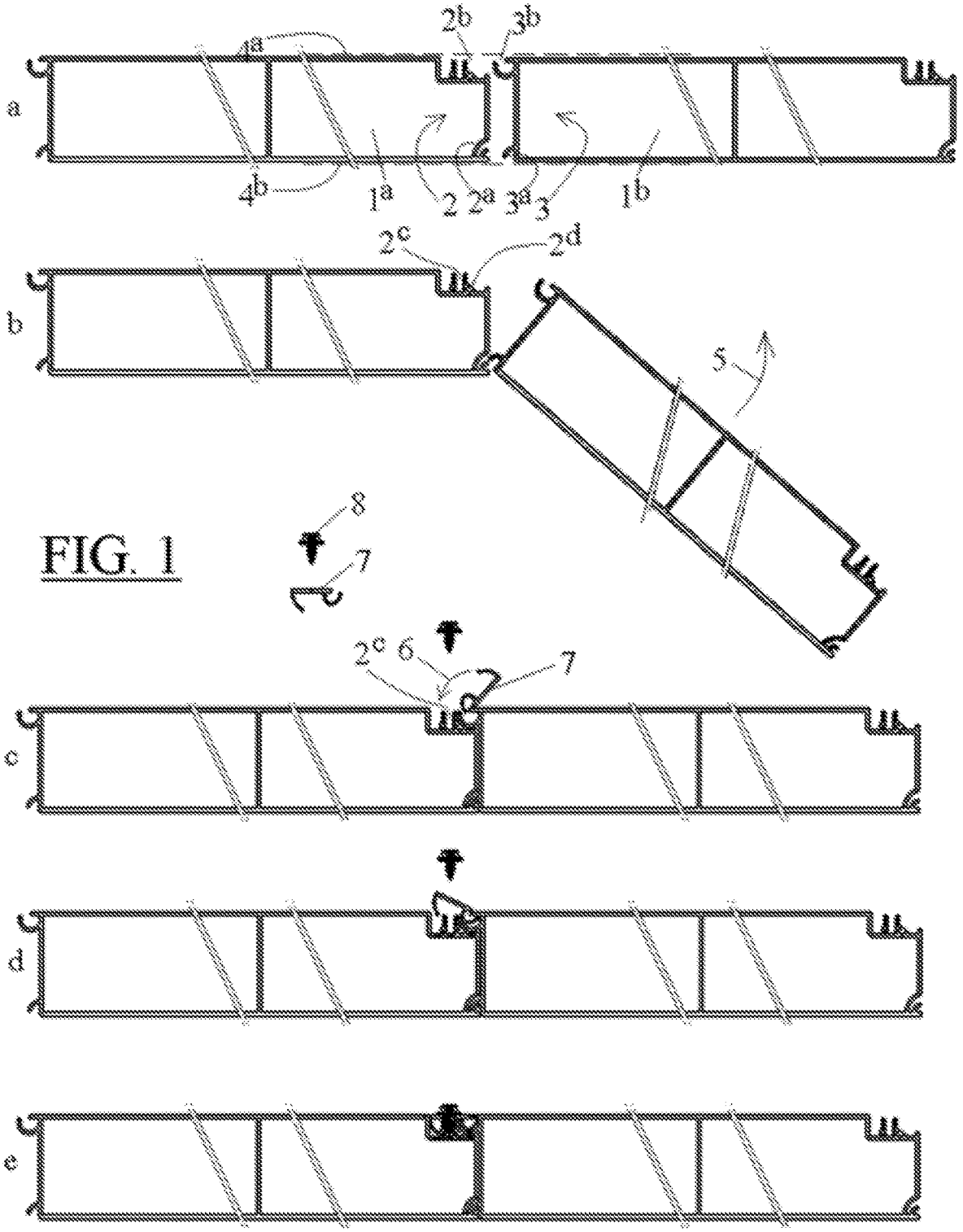
FIG. 1 shows a cross section of two adjacent housings which are coupled, by way of their sides, to one another by means of a pivoting movement.

FIG. 1 shows two devices according to the invention, each intended and configured as a cover element for forming, coupled with similar cover elements, a floating covering for the contents of a liquid tank. The devices shown each comprise an elongate housing 1*a* and 1*b*, respectively (shown in cross section in FIGS. 1*a-e*), having a first longitudinal coupling profile 2 made of extruded material on one side extending in the length direction, and a second longitudinal coupling profile 3 made of extruded material on the other side. Both longitudinal coupling profiles 2 and 3 are configured such that the two adjacent housings 1*a* and 1*b* may be coupled to one another by means of the first longitudinal coupling profile 2 of the one housing 1*a* and the second longitudinal coupling profile 3 of the adjacent housing 1*b*. The first longitudinal coupling profile 2 and second longitudinal coupling profile 3 do not protrude above or below the upper main plane 4*a* and lower main plane 4*b* of the housings 1*a* and 1*b*. The lower portions of the first longitudinal coupling profile 2 and the second longitudinal coupling profile 3 have a first hook hinge profile 2*a* and a second hook hinge profile 3*a*, respectively, which are configured, and shaped, in such a way that the housings 1*a* and 1*b* may be hooked together at the bottom in a hinged manner by means of the first hook hinge profile 2*a* and second hook hinge profile 3*a* (see FIG. 1*b*), after which the top sides of said housings may be moved towards each another (see arrow 5 in FIG. 1*b*). The upper portions of the first longitudinal coupling profile 2 and second longitudinal coupling profile 3 have a first top coupling profile 2*b* and a second top coupling profile 3*b*, respectively, which are configured to be able to be coupled to one another by means of a locking profile 7 that can be fitted (see arrow 6 in FIG. 1*c*) over the first top coupling profile 2*b* and the second top coupling profile 3*b*. Lastly, the locking profile 7 may then also (optionally) be anchored by means of a number of self-tapping screws 8 which engage with a screw sleeve 2*c* provided on the first top coupling profile 2*b*. In addition, the first top coupling profile 2*b* is also provided with a sealing profile 2*d* in which a sealing gasket is fitted in order to mutually seal the housings 1*a* and 1*b* as well as possible with respect to the escape of vapours etc. from the tank liquid below which is to be protected by the floating roof.

It is noted that the side walls and the top and bottom wall, including the coupling profiles 2 and 3, are preferably formed as a single piece by means of extrusion of, for example, aluminium. However, it is for example also possible for the housing to have a honeycomb structure, which in turn does not lend itself to being extruded, however. In that case, the coupling profiles 2 and 3 are extruded separately, after which they are fitted against the side walls of the housing, for example by means of adhesive bonding and/or welding.

Figure 2:
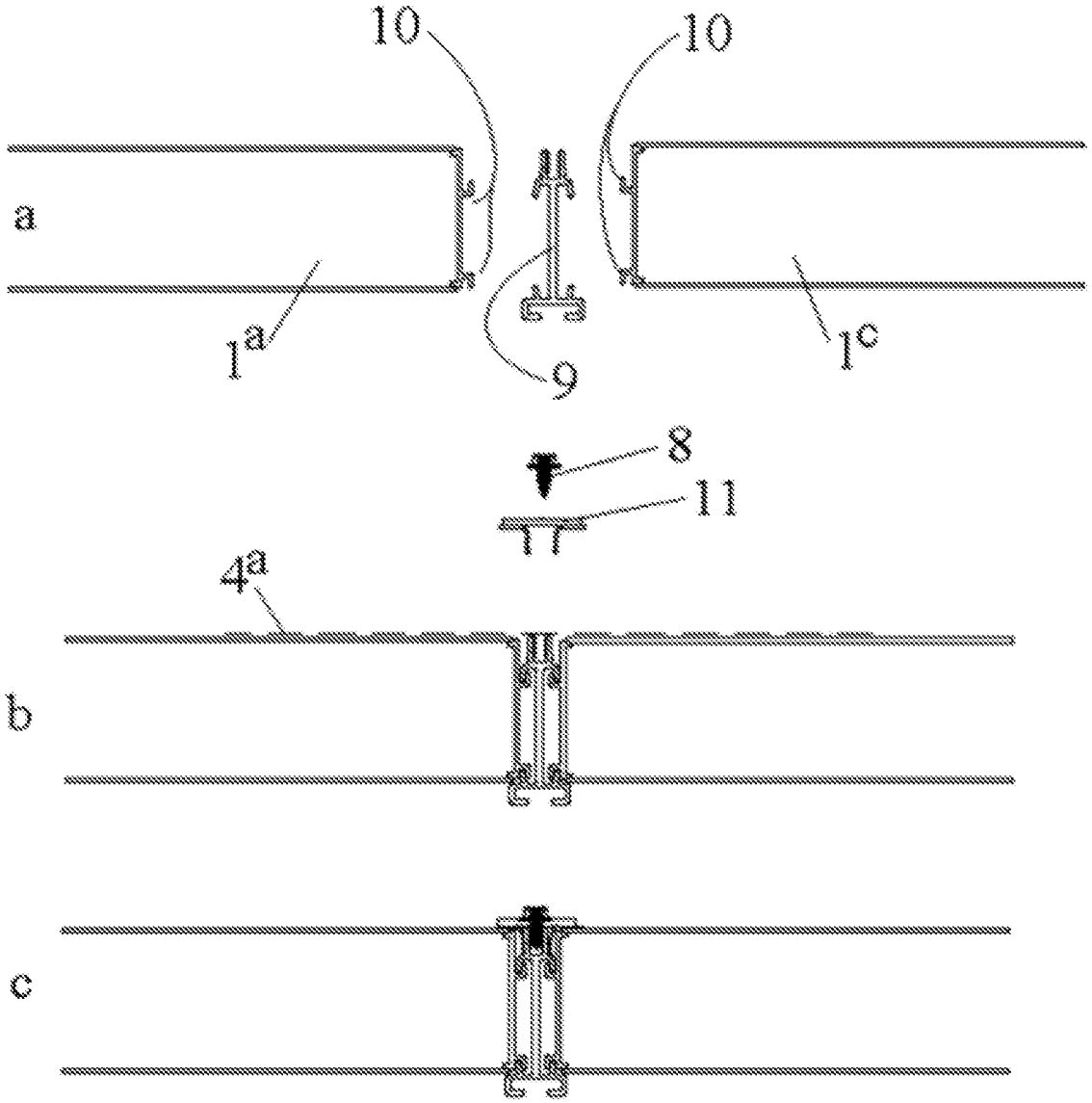
FIG. 2 shows a longitudinal section of two adjacent housings which are coupled, by way of their end faces, to one another by means of a sliding coupling profile.

FIG. 2 shows a longitudinal section of two adjacent housings 1*a* and 1*c* which are coupled, by way of their end (transverse) faces, to one another by means of a sliding coupling profile 9. The end faces of the housings 1*a* and 1*c* are provided with a transverse coupling profile 10 which is configured to cooperate, for the purpose of mutually coupling the housings at the end faces, with the sliding coupling profile 9 which is configured to be able to be slid over or through (specifically when the transverse coupling profiles 10 are provided with one or more coupling openings) the transverse coupling profiles 10 of both adjacent housings 1*a* and 1*c*. A cover strip 11 is subsequently fitted which is fastened by means of self-tapping screws 8.

It is noted that although said coupling profiles 2, 3, 9 and 10 do not protrude above the upper main plane 4*a* of the housings 1, the screws 8 and the cover strip 11 do protrude to a very minor extent, but this does not significantly detract from the advantage obtained by means of the construction according to the present invention, specifically that there are no longer any upwardly protruding edges when this construction is used, as a result of which the top plane of the "floating roof" formed by the coupled-together housings—in comparison with the hitherto used floating roofs with upwardly protruding coupling flanges—affords considerable advantages during use and maintenance of the storage tank.

The invention claimed is:

1. A device, intended and configured as a cover element for forming, coupled with similar cover elements, a floating covering for contents of a liquid tank, which device comprises an elongate housing having a first longitudinal coupling profile on one side and a second longitudinal coupling profile on another side, wherein both longitudinal coupling profiles are configured such that two adjacent housings may be coupled to one another by means of the first longitudinal coupling profile of the one housing and the second longitudinal coupling profile of adjacent housing, wherein the first longitudinal coupling profile and the second longitudinal coupling profile do not protrude substantially above or below an upper main plane of the housing, wherein lower portions of the first longitudinal coupling profile and the second longitudinal coupling profile have a first hook hinge profile and a second hook hinge profile, respectively, which are configured, and shaped, in such a way that the housings may be hooked together at bottom in a hinged manner, after which top sides of said housings may be moved towards each other, and wherein upper portions of the first longitudinal coupling profile and of the second longitudinal coupling profile have a first top coupling profile and a second top coupling profile, respectively, which are configured to be able to be coupled to one another by means of a locking profile that can be fitted over the first top coupling profile and the second top coupling profile.

2. The device according to claim 1, wherein end faces of the housing are provided with a transverse coupling profile which is configured to cooperate to couple similar housings at the end faces, with a sliding coupling profile which is configured to be able to be slid over or through the transverse coupling profiles of both adjacent housings.

* * * * *